US007270048B2

(12) United States Patent
Becker et al.

(10) Patent No.: US 7,270,048 B2
(45) Date of Patent: Sep. 18, 2007

(54) PUMP

(75) Inventors: Erich Becker, Bad Krozingen (DE); Erwin Hauser, Emmendingen (DE)

(73) Assignee: KNF Neuberger GmbH, Freiburg (DE)

( * ) Notice: Subject to any disclaimer, the term of this patent is extended or adjusted under 35 U.S.C. 154(b) by 87 days.

(21) Appl. No.: 10/507,856

(22) PCT Filed: Mar. 12, 2003

(86) PCT No.: PCT/EP03/02524

§ 371 (c)(1),
(2), (4) Date: Sep. 15, 2004

(87) PCT Pub. No.: WO03/078841

PCT Pub. Date: Sep. 25, 2003

(65) Prior Publication Data

US 2005/0112004 A1 May 26, 2005

(30) Foreign Application Priority Data

Mar. 19, 2002 (DE) ..... 102 12 239

(51) Int. Cl.
*F15B 21/04* (2006.01)
*F01B 9/00* (2006.01)

(52) U.S. Cl. ..... 92/82; 92/78; 92/140

(58) Field of Classification Search ..... 92/78, 92/82, 99, 101, 140
See application file for complete search history.

(56) References Cited

U.S. PATENT DOCUMENTS 2,176,691 A 10/1939 Simons
2,204,814 A 6/1940 Newell
2,873,687 A * 2/1959 Pritchard ..... 92/99
2,981,197 A 4/1961 Dolza
3,844,688 A 10/1974 Bulkley et al.

FOREIGN PATENT DOCUMENTS

| | | |
|---|---|---|
| BE | 1 010 852 | 2/1999 |
| DE | 975 981 | 1/1963 |
| DE | 692 03 605 | 1/1996 |
| DE | 201 19 407 | 3/2002 |
| GB | 600 460 | 4/1948 |

OTHER PUBLICATIONS

Niemann, G: Maschinenelemente. Band 1 Konstruktion und Berechnung von Verbindungen, Lagern, Wellen. 2. neubearb. Auflage Berlin [u.a]: Springer, 1975, (16 Schmierstoffe, Schmierung und Dichtung, Tafel 16/8. Gebräuchliche berührende Dichtungen), S. 342. ISBN: 3-540-06809-0.

* cited by examiner

*Primary Examiner*—Michael Leslie
(74) *Attorney, Agent, or Firm*—Volpe and Koenig, P.C.

(57) ABSTRACT

A pump (1) with an oscillating part having a housing (2) with a working chamber (3) and a crankcase (4) defined from the working chamber by the pump part. A pump drive mechanism (6) with a drive shaft (7) is located inside the crankcase (4) and the drive shaft is mounted on bearings (8, 9) that are arranged in the walls of the crankcase. The pump has a suction inlet separate from the crankcase. The pump (1) includes at least one flow channel in the crankcase wall for compensating pressure in the crankcase when the pump part oscillates and a flow damper arranged in the at least one flow channel. In a preferred embodiment, the at least one passage hole having at least one bearing therein is configured as the flow channel.

9 Claims, 1 Drawing Sheet

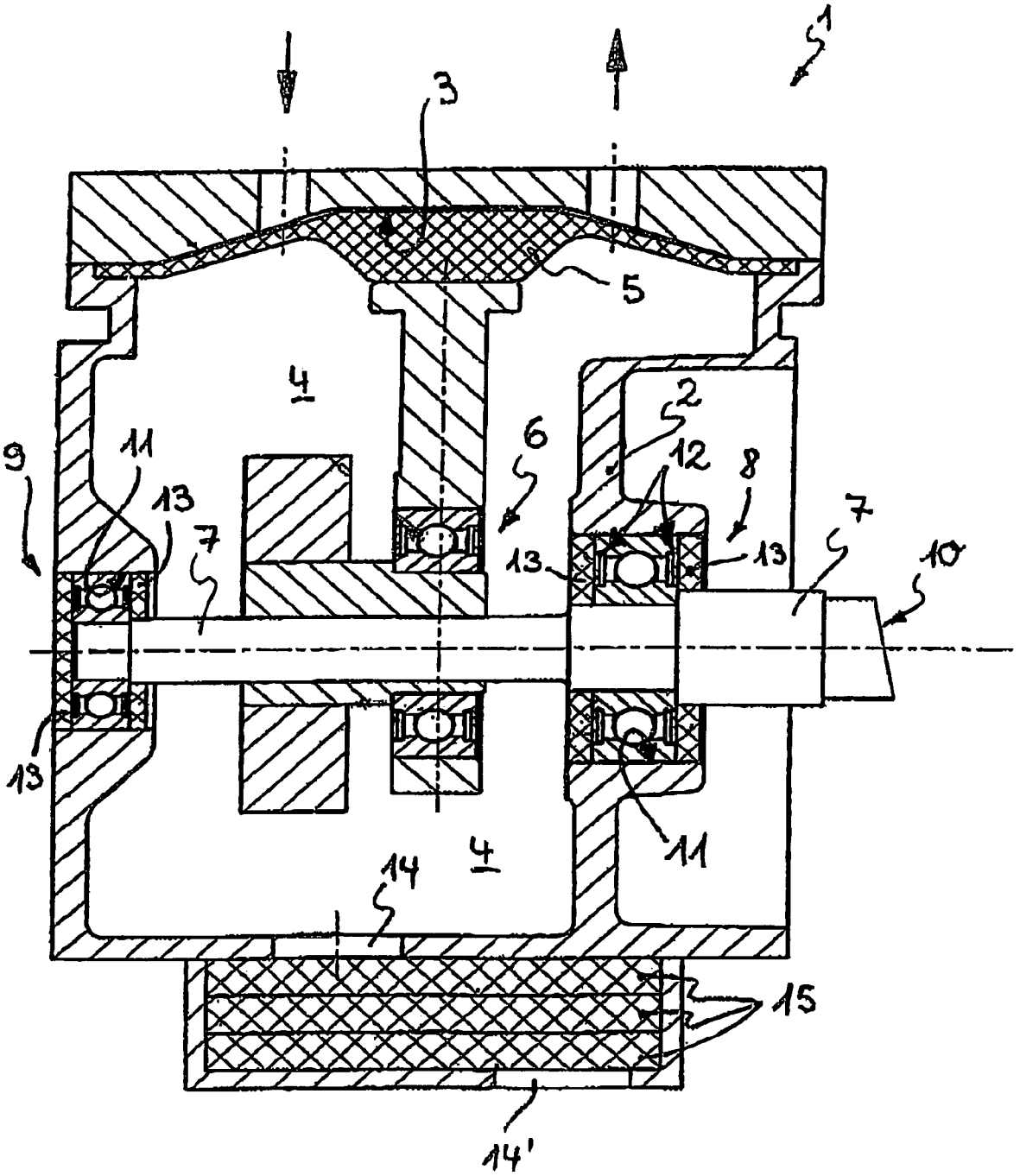
1
3
5
4
2
6
12
8
9
11
13
7
13
13
7
10
13
11
4
14
15
14'

PUMP

The invention relates to a pump with an oscillating pump part, wherein the pump has a pump housing with a working chamber and a crankcase separated from this chamber by the pump part. A pump drive with a drive shaft is located inside the crankcase and the drive shaft is mounted on bearings arranged in the crankcase walls. At least one of the bearings is positioned in a passage hole in a crankcase wall, and at least one flow channel for equalizing pressure in the crankcase during oscillating motion of the pump part is provided in the crankcase walls and a flow damper is arranged in the at least one flow channel. In addition, the pump has a suction inlet separate from the crankcase.

Various pumps of the type mentioned in the introduction, which operate as compressor or vacuum pumps, are already known. These known pumps, which are embodied as piston or diaphragm pumps, have a reciprocating piston or a diaphragm as an oscillating pump part. The known pumps have a pump housing, in which the oscillating pump part separates a working chamber from a crankcase. In the crankcase, a pump drive with a drive shaft is provided, which is mounted on bearings arranged in the crankcase walls. To connect one end of the shaft extending out of the crankcase to a drive motor, at least one of these bearings is positioned in a passage hole located in the crankcase wall and leading out of the crankcase.

It is already known to provide the bearings of such pumps as grease-lubricated bearings. So that no grease leaks out of the bearings and thus reduces the lubrication effect even for a hot pump, the bearings of these known pumps are covered on the sides with cover disks. These cover disks form a non-contact seal with the ball-bearing inner ring.

However, the oscillating motion of the pump parts also inevitably increases or decreases the pressure in the crankcase corresponding to the pump cycle. Here, the incoming and outgoing air can escape through the bearing positioned in the passage hole by means of a gap held open by the cover disks. Because the cross section of this gap is very small due to the desired sealing effect, the air takes on a high velocity in this space, which becomes noticeable as an unpleasant noise. In addition, there is the risk that the bearing grease will slowly be displaced away from the ball bearing.

Such pumps are frequently used in laboratories or also operating rooms, where such disruptive noises could significantly and negatively affect the concentration of the attendants.

From U.S. Pat. No. 2,176,691, a compressor is known that has a piston as the oscillating pump part. The compressor includes a pump housing with a working chamber that is separated from the crankcase by the pump part. An oil bath is located in the crankcase in which the drive shaft for the pump drive is provided. The drive shaft is supported by bearings located in the crankcase housing walls. In this manner, the crankcase housing is tub shaped and is formed as an oil bath carrying housing box, in which the drive shaft is inserted through a side opening in the housing. The opening in the side of the housing box is not only for the insertion of the drive shaft, but also at the same time provides a ventilation opening during the up and down movement of the piston used as the pump part. A filter arrangement is located in the side opening in order to prevent an undesired discharge of oil-air mixture due to the turbulence in the crankcase.

The opening in the housing forming the crankcase of the previously known compressor and the covering with a large filter arrangement requires a corresponding expenditure. For comparatively smaller pumps with a correspondingly small crankcase housing, no room is available for such a side housing opening without further arrangements.

From GB 600 460 A, an oil lubricated compressor is known, in which the drive shaft is sealed in housing openings using a shaft seal. For pressure relief from the crankcase, the crankcase housing includes a ventilation channel. The use of such a ventilation channel in a crankcase however is connected with additional manufacturing and construction costs. An arrangement with drive shaft seals with a pressure relief for the crankcase in the form of a ventilation channel similar to GB 600 460 A is also known from U.S. Pat. No. 2,981,197.

SUMMARY

Therefore, there is the object of creating a pump of the type mentioned in the introduction, which distinguishes itself by an especially noiseless operation and which at the same time has a low manufacturing and construction cost.

According to the invention, the solution of this object is provided for a pump of the type known in the art, wherein at least one passage hole for at least one bearing is provided as a flow channel, and in a region of the at least one bearing positioned in the passage hole that forms the flow channel there is a flow damper covering an open channel cross section.

The pump according to the invention has at least one or more passage holes for at least one bearing that is provided as a flow channel, which equalizes the pressure in the crankcase during the oscillating motions of the pump part. The in the area of the one or more flow channels formed from passage holes with the bearings have a flow damper covering an open channel cross section which greatly reduces the flow rate through the bearing. In this way the speed of the ventilation flow through the bearing is so reduced, that noise generated by the air flow is also greatly reduced. With the pump according to the invention with at least one or more bearings located in openings that act as ventilation channels, the need for a separate ventilation opening in the crankcase housing is eliminated. Therefore, the manufacturing and construction costs of the pump according to the invention can be not insignificantly reduced.

From DE 201 19 407 U1, an oil-less air compressor is known, which has a compressor housing that is divided into a crankcase housing and a working cylinder by an oscillating piston. There is a return valve on the piston, which allows the air to flow from the crankcase housing through the return valve into the cylinder. To realize the suction control just through the crankcase housing, the working cylinder is provided with only an air outlet opening and a return valve. The crankcase housing is provided on one side with an air inlet opening, which covers an air filter. The known air compressor does not have suction control independent of the crankcase housing.

In Niemann, G., Maschinenelemente [Machine elements], Vol. 1, Konstruktion und Berechnung von Verbindungen, Lagern, Wellen [Construction and Calculation of Connectors, Bearings, Shafts], Verlag Springer, Berlin, 2nd edition 1975, pg. 342, various common contact seals are described. Among other things, this publication also describes felt-ring seals, which seal the gap remaining between a shaft set through a passage hole on one side and the housing wall limiting the passage hole on the other side. To enable the sole sealing function of the felt-ring seals, this gap is dimensioned as small as possible from the start, so that unsealed points and corresponding flows can be prevented as much as possible.

A comparable felt-ring seal is described in DE 692 03 605 T2.

From DE-PS 975 981, a shaft seal, which has a labyrinth packing on both sides of a shaft bearing located in a passage hole, is already known. The passages of the labyrinth packing are dimensioned so tight that almost no flow throughput is possible. In addition, at least in certain sections, the passages of the labyrinth packings are held at a pressure, which is higher than the pressure prevailing outside of the bearing. In this way, the labyrinth packings of the known shaft seal can effectively stop any flow throughput in the region of the passage hole.

In one especially advantageous embodiment according to the invention, which itself is worthy of protection, at least one passage hole with at least one bearing is provided as a flow channel and a flow damper covering the open channel cross section, arranged in the region of the one or more bearings positioned in the passage hole embodied as a flow channel. For this embodiment of the invention, which is associated with especially low manufacturing costs, at least one passage hole with at least one bearing is provided as the flow channel. Because a flow damper is also arranged in the passage hole forming the flow channel, the amount of air flowing through the bearing is greatly reduced. Therefore, the flow rate in the gap remaining in the bearing decreases so much that the noise generated by the air flow is also greatly reduced.

In one especially advantageous embodiment according to the invention, which itself is worthy of protection, at least one passage hole with at least one bearing is provided as a flow channel and a flow damper covering the open channel cross section, arranged in the region of the one or more bearings positioned in the passage hole embodied as a flow channel. For this embodiment of the invention, which is associated with especially low manufacturing costs, at least one passage hole with at least one bearing is provided as the flow channel. Because a flow damper is also arranged in the passage hole forming the flow channel, the amount of air flowing through the bearing is greatly reduced. Therefore, the flow rate in the gap remaining in the bearing decreases so much that the noise generated by the air flow is also greatly reduced.

In one especially simple and advantageous embodiment according to the invention, the flow damper is formed by one or more disks made from open-pore material or a similar gas-permeable material with high pneumatic resistance. Here, the flow damper can be formed, e.g., of one or more disks made from open-pore foam material.

However, it is preferred if the flow damper is formed by one or more felt or fleece disks.

To eliminate the pulsing pressure increase generated by the high pneumatic resistance in the pump housing and the oscillating pump part, it can be advantageous if there is at least one relief opening in the crankcase wall. This opening is preferably covered with a flow damper. Air can be exchanged through this relief opening in the crankcase wall such that the air flow must be forced just barely through the bearing located in the passage holes.

This is even more favorable when the pneumatic resistance in the region of the bearing opening(s) is greater than that in the region of the relief opening(s).

It is especially advantageous when the flow damper is provided on both sides of the bearing positioned in a passage hole.

The present invention can be used, e.g., in reciprocating piston pumps with a reciprocating piston used as the pump part. However, in one preferred embodiment according to the invention, the pump is provided as a diaphragm pump and its oscillating pump part is a diaphragm.

BRIEF DESCRIPTION OF THE DRAWINGS

Other features of the invention can be found in the following description of an embodiment according to the invention in connection with the claims, as well as the drawing. According to the invention, the individual features can be reduced to practice by themselves or in combinations.

The single drawing FIGURE is a cross-sectional view through a pump in accordance with the invention.

The single FIGURE shows a diaphragm pump 1, which operates as a compressor or vacuum pump. The diaphragm pump 1 has a pump housing 2, in which a working chamber 3 defined by an oscillating pump part is separated from a crankcase 4. A diaphragm 5 made from elastic material, which is tensioned at its periphery in the pump housing 2 and which can be set into oscillating motion by means of an eccentric drive used as the pump drive 6, is used as the pump part.

The diaphragm 5 is here illustrated in an upper dead point, in which it nearly fills the working chamber 3 in a form fit.

The pump drive 6 is provided with a drive shaft 7 in the crankcase 4. The drive shaft 7 is mounted on both sides of the eccentric drive 6 in roller bearings 8, 9, which are arranged in the crankcase walls and formed here as ball bearings. To connect the shaft end 10 projecting out of the crankcase 4 to a drive motor, at least the bearing 8 is positioned in a passage hole 11 located through the crankcase wall and leading out of the crankcase 4.

For the pump 1 shown here, the bearing 9 on the opposite crankcase wall is also positioned in a passage hole 11 leading out of the crankcase 4.

So that no grease can leak out of the grease-lubricated bearings 8, 9 and thus reduce the lubrication effect even for a hot pump 1, the bearings 8, 9 are covered on both sides by cover disks 12. These cover disks form a non-contact seal with the ball-bearing inner ring.

As can be seen from the drawing, a flow damper covering the bearing opening is arranged in the region of the bearings 8, 9 positioned in the passage holes 11 of the crankcase walls. This flow damper is here formed by disks 13 made from fleece, felt, or a similar gas-permeable material with high pneumatic resistance. These disks are provided on both sides of the bearing.

The amount of air flowing through the bearing and especially the remaining gap between the inner and outer ring of the bearing is greatly reduced by the flow damper(s). Therefore, the flow rate in the bearing gap decreases so much that the noise generated by the air flow is also strongly reduced. The pump 1 shown here thus distinguishes itself by an especially noiseless operation.

To reduce the pulsing pressure increase generated by the high pneumatic resistance in the pump housing and the oscillating pump part 5, a relief opening 14, 14' is also provided, which is here covered by a flow damper. The flow damper allocated to the relief opening 14, 14' is also formed from several gas-permeable disks 15 with high pneumatic resistance, especially made from several fleece or felt disks. The relief opening 14, 14' is dimensioned so that the resistance in the region of the bearing openings of the bearings 8, 9 is greater than that in the region of the relief opening 14, 14'. In addition to or instead of this, the disks 15 can also be selected so that their pneumatic resistance is smaller than the resistance in the region of the bearings 8, 9. This also prevents the pressure between the crankcase 4 and the atmosphere from being only partially equalized via the bearings 8, 9; at the same time, it is guaranteed that the grease necessary for bearing lubrication cannot flow outwards.

The pump illustrated here distinguishes itself through an especially noiseless operation.

The invention claimed is:

1. Pump (1) with an oscillating pump part, comprising a pump housing (2) with a working chamber (3) and a crankcase (4) separated from the chamber by the pump part, a pump drive (6) with a drive shaft (7) is located in the crankcase, the drive shaft is mounted on bearings (8, 9) arranged in walls of the crankcase, and at least one of the bearings is positioned in a passage hole (11) in the crankcase wall, the pump has a suction inlet separate from the crankcase, at least one flow channel for equalizing pressure in the crankcase during oscillating motion of the pump part is provided in the crankcase walls and a flow damper is arranged in the at least one flow channel, wherein the at least one flow channel comprises the passage hole (11) with the at least one bearing, and in a region of the at least one bearing (8, 9) positioned in the passage hole (11) that forms the flow channel, the flow damper is fixed in the housing and covers an open channel cross section of the flow channel to damp inward and outward air flow.

2. Pump according to claim 1, wherein the flow damper is formed by one or more disks (13) made from open-pore material or a gas-permeable material with a high pneumatic resistance.

3. Pump according to claim 1, wherein the flow damper is formed by one or more felt and/or fleece disks (13).

4. Pump according to claim 1, wherein at least one relief opening (14, 14') is provided in the crankcase wall, which is covered with a second flow damper.

5. Pump according to claim 4, wherein a pneumatic resistance in a region of the bearing openings is greater than that in a region of the at least one relief opening (14, 14').

6. Pump according to claim 4, wherein the pump (1) comprises a diaphragm pump and the oscillating pump part comprises a diaphragm (5).

7. Pump according to claim 1, wherein the pump (1) comprises a diaphragm pump and the oscillating pump part comprises a diaphragm (5).

8. Pump (1) with an oscillating pump part, comprising a pump housing (2) with a working chamber (3) and a crankcase (4) separated from the chamber by the pump part, a pump drive (6) with a drive shaft (7) is located in the crankcase, the drive shaft is mounted on bearings (8, 9) arranged in walls of the crankcase, and at least one of the bearings is positioned in a passage hole (11) in the crankcase wall, the pump has a suction inlet separate from the crankcase, at least one flow channel for equalizing pressure in the crankcase during oscillating motion of the pump part is provided in the crankcase walls and a flow damper is arranged in the at least one flow channel, the at least one flow channel comprises the passage hole (11) with the at least one bearing, and in a region of the at least one bearing (8, 9) positioned in the passage hole (11) that forms the flow channel, the flow damper covers an open channel cross section of the flow channel, wherein the flow damper is provided on both sides of the bearing positioned in the passage hole (11).

9. Pump according to claim 8, wherein the pump (1) comprises a diaphragm pump and the oscillating pump part comprises a diaphragm (5).

* * * * *